US005653444A

United States Patent [19]

Dahl

[11] Patent Number: 5,653,444

[45] Date of Patent: Aug. 5, 1997

[54] METHOD OF PLAYING A PLAYER-VERSUS-DEALER STUD POKER GAME AT A GAMING TABLE

[75] Inventor: Danny H. Dahl, Las Vegas, Nev.

[73] Assignee: Brazil Gaming, Inc., Las Vegas, Nev.

[21] Appl. No.: 517,037

[22] Filed: Aug. 21, 1995

[51] Int. Cl.[6] ..... A63F 1/00

[52] U.S. Cl. ..... 273/274; 273/292

[58] Field of Search ..... 273/274, 292, 273/304; 463/11, 12, 13, 26, 27, 28

[56] References Cited

U.S. PATENT DOCUMENTS

| | | | |
|---|---|---|---|
| 2,607,595 | 8/1952 | Mathes | 273/304 |
| 4,836,553 | 6/1989 | Suttle et al. | 273/292 |
| 4,995,615 | 2/1991 | Cheng . | |
| 5,013,049 | 5/1991 | Tomaszewski . | |
| 5,072,946 | 12/1991 | Miller . | |
| 5,100,137 | 3/1992 | Fulton | 273/274 |
| 5,251,897 | 10/1993 | Fulton | 273/274 |
| 5,265,882 | 11/1993 | Malek . | |
| 5,275,415 | 1/1994 | Wisted . | |
| 5,275,416 | 1/1994 | Schoor et al. . | |
| 5,280,915 | 1/1994 | Groussman . | |
| 5,320,356 | 6/1994 | Cauda . | |
| 5,332,219 | 7/1994 | Marnell, II et al. | 463/13 |
| 5,350,175 | 9/1994 | DiLullo et al. . | |
| 5,356,140 | 10/1994 | Dabrowski et al. . | |
| 5,374,067 | 12/1994 | Jones | 273/292 |
| 5,377,973 | 1/1995 | Jones et al. . | |
| 5,380,012 | 1/1995 | Jones | 273/292 |
| 5,397,128 | 3/1995 | Hesse et al. . | |
| 5,411,268 | 5/1995 | Nelson et al. . | |
| 5,417,430 | 5/1995 | Breeding | 273/274 |
| 5,466,010 | 11/1995 | Spooner | 273/294 |
| 5,544,892 | 8/1996 | Breeding | 273/292 |

OTHER PUBLICATIONS

"Royal Match", Bet Technology, Inc, 1991, 273/304.

*Primary Examiner*—William M. Pierce
*Attorney, Agent, or Firm*—Joseph C. Andras

[57] ABSTRACT

A method of playing a stud poker game in a player-versus-dealer gaming table environment is disclosed. In a preferred method, the player places an "ante" wager whereupon he and the dealer receive a three-card portion of a five-card poker hand with two of the dealer's three cards face up. The player may then compare his partial three-card poker hand with the dealer's two up cards and exercise his option of either "surrendering" the original "ante" wager or placing an additional "challenge" wager to receive the remainder of his five-card poker hand. After he and the dealer have received their entire five-card poker hand, an ordinary showdown takes place. If the player's poker hand beats the dealer's, then the house pays even money on the original "ante" wager and on the challenge wager. In a preferred embodiment, the player must have at least an ace high hand to prevail. In a further enhancement, the player may also place an optional "side" wager at the time that the "ante" wager is made in order to receive a fixed or return for forming certain hands and, in particular, for spelling a word such as "VEGAS" using letters carried by particular cards in an otherwise standard 52-card deck. The "side" wager is paid to the house, along with the "ante" wager, in the event of a surrender.

14 Claims, 2 Drawing Sheets

METHOD OF PLAYING A PLAYER-VERSUS-DEALER STUD POKER GAME AT A GAMING TABLE

BACKGROUND OF THE INVENTION

1. Field of the Invention

This invention relates to a stud poker game and, more particularly, to a stud poker game in which a player may place an "ante" wager after which he and the dealer are dealt a three-card portion of a five-card poker hand, two of the dealer's three cards being dealt face-up, the player then comparing his three-card poker hand with the dealer's two up cards and deciding whether or not to surrender the original "ante" wager at this point or, instead, to place an additional "challenge" wager and then receive the remainder of the five-card poker hand. The game may be further enhanced with an optional, minimum $1, "side" wager in which the player receives a specified return for forming certain hands, and preferably including a specific return for spelling a word such as "VEGAS" using letters carried by particular cards in an otherwise standard 52-card deck.

2. Description of Related Art

Poker is one of the most fascinating of the gambling games because it includes a good mix of skill, luck, and psychology. Every year millions of players are drawn to card tables around the world to try their luck at poker.

Poker is typically played between players, as opposed to between a player and a house dealer. Many players desire a player-versus-player game because it allows the elements of skill and psychology to play a larger part in the game. However, many other players would prefer to play against the house at a standard gaming table. Like blackjack, however, many such table games tend to minimize the elements of skill and psychology and rely more on luck.

There remains a need in the gaming business, therefore, for a poker-like game which can be played at a gaming table that provides an appropriate mix of the three elements of skill, luck, and psychology.

OBJECTS AND SUMMARY OF THE INVENTION

The present invention comprises a method of playing a card game that is superficially similar to stud poker, but which is suited for a dealer-versus-player format at a gaming table. In a preferred embodiment, the method comprises the steps of accepting an ante wager and a player-optional side wager, and thereafter alternately dealing three cards to the player and three cards to the dealer in rotation from a deck of playing cards. At this point, the method comprises the further steps of displaying at least two of the dealer's three cards as up cards for review by the player, and then permitting the player to either "surrender" his ante wager and side wager, if made, or to place an additional "challenge" wager based on the comparison of his own three cards and the dealer's up cards. If the player surrenders, the method continues by comprising the steps of removing the player's ante wager and dealing no further cards to the player. If the player decides, however, to challenge, the method continues with the steps of accepting the player's challenge wager, which preferably can be from $1 to up to two times the player's ante wager, and then alternately dealing two more cards face up to the player and two more cards face down to the dealer to form two ordinary five-card poker hands, and then comparing the player's five-card poker hand with the dealer's five-card poker hand.

In the preferred embodiment, the method comprises the additional step of accepting a side wager from the player, preferably for $1, wherein the player will be paid a certain paytable return for obtaining certain specified hands. In the preferred embodiment that includes the step of accepting a side wager, the game would also further include the step of removing that side wager should the player decide to surrender. As a further enhancement of this method, certain cards in an otherwise standard 52-card deck can be modified to carry indicia such as the letters "V," "E," "G," "A," and "S," whereby the player can obtain a specified paytable amount for forming a hand containing such cards.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a method of playing a stud poker game.

I. Description of the Game

Figure 2:
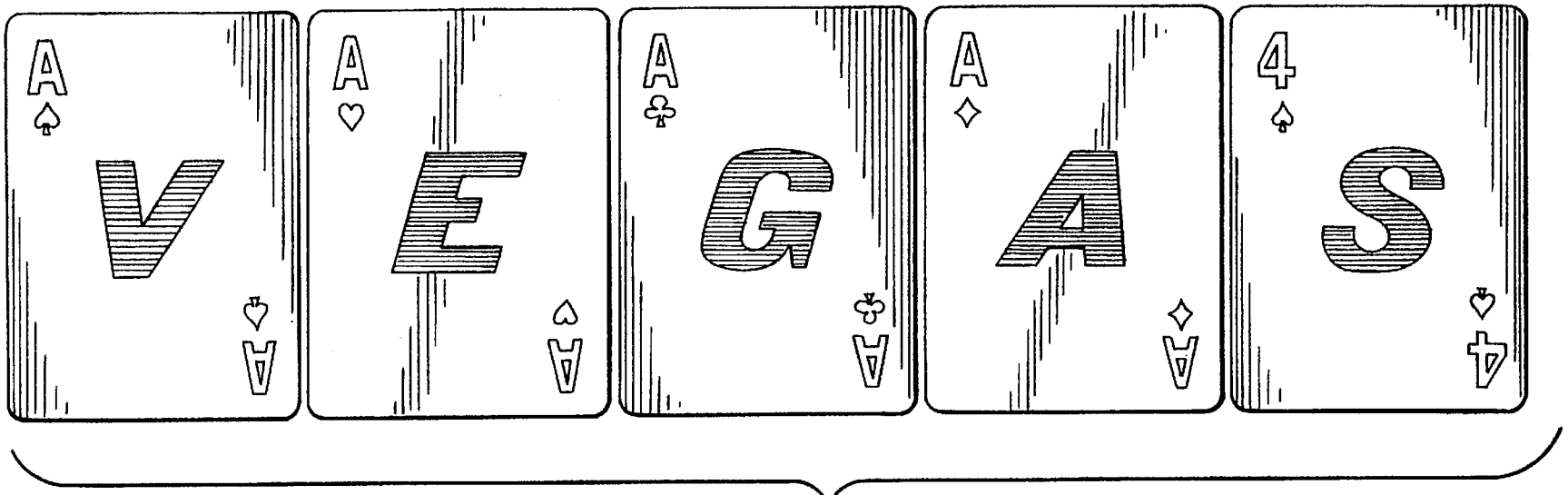
" and FIG. 2 shows a preferred modification to five out of a 52-card deck of cards in which each of the four aces has been modified to respectively carry the letters "V," "E," "G," "A," and the four of spades has been modified to carry the letter "S" to provide a possible five-card hand which spells out the preferred word "VEGAS."

The preferred game uses a standard 52-card poker deck, except that five of the cards are modified as shown in FIG. 2 wherein the ACE OF SPACES has the letter "V" on the card; the ACE OF HEARTS has the letter "E" on the card; the ACE OF CLUBS has the letter "G" on the card; the ACE OF DIAMONDS has the letter "A" on the card; and the 4 OF SPADES has the letter "S" on the card.

Figure 1:
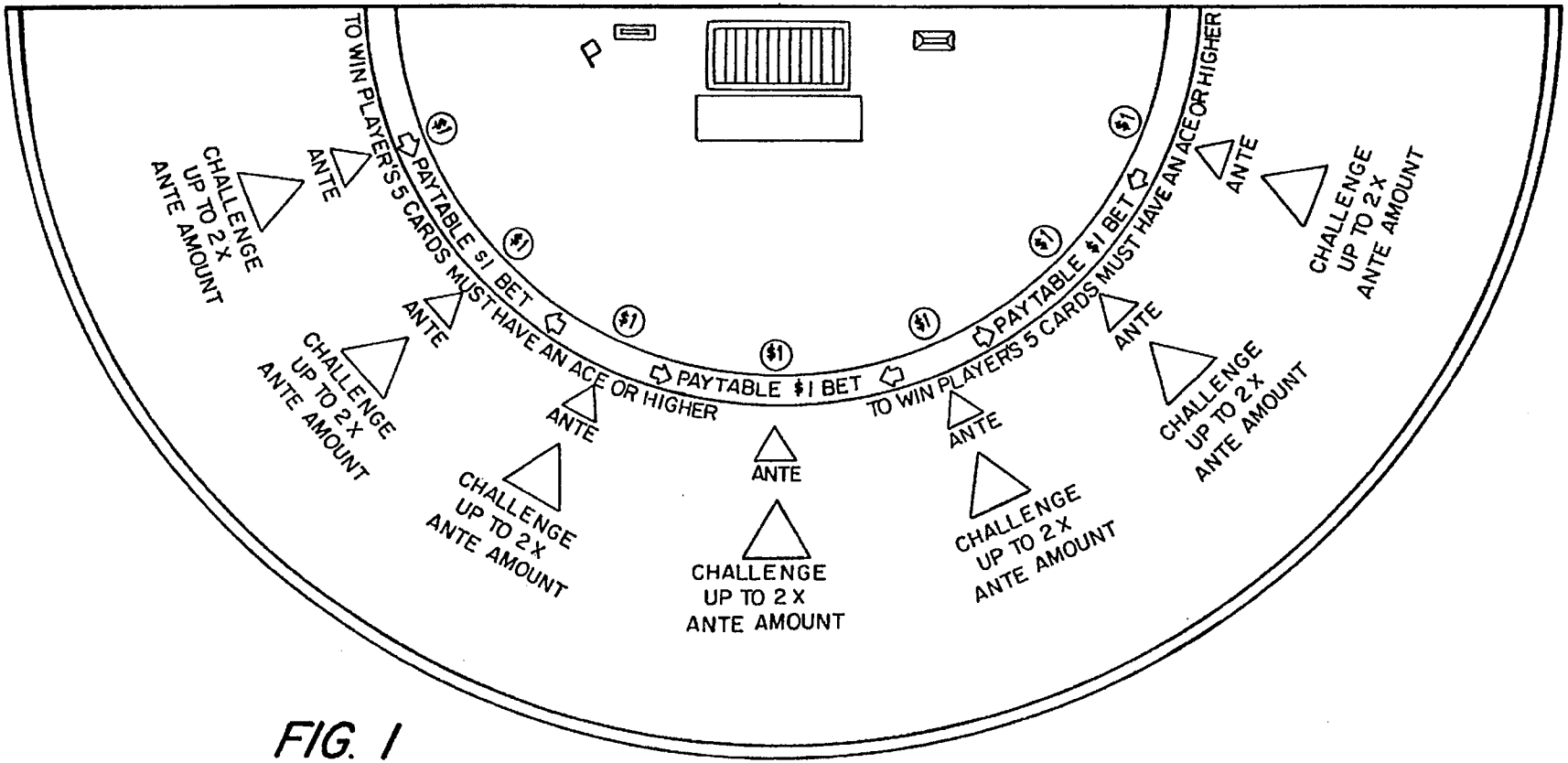
FIG. 1 is a top plan view of a gaming table for playing a preferred version of the present invention called "Vegas Aces Stud Poker.

The following brief description is best understood with reference to FIG. 1 and sets forth the preferred method of play:

- Each player makes an initial wager (called the ante) up to the table limit of the game, and optionally makes a $1 side wager.
- Each player and the dealer are dealt three cards left to right.
- The dealer exposes two of his cards (left to right), and leaves the third card face down.
- The player compares his three-card hand to the dealer's two exposed cards and decides whether he would like to challenge the dealer's ultimate five-card hand with the player's ultimate five-card hand.
- If the player elects to challenge, he places an amount of $1 up to double his original ante wager in the designated challenge area on the game layout.

If the player decides not to challenge, then his original ante wager is surrendered with the paytable side wager.

If the player decides to challenge, dealer then places the top card in the deck face down in the card holder and then two additional cards are dealt face up to each player remaining in the game, and to the dealer, in rotation. The dealer's remaining two cards are preferably dealt face down.

The game's objective is to beat the dealer's five-card poker hand with the player's five-card poker hand.

The possible hand outcomes are as follows:

The player loses ante (surrender) if he decides not to challenge after looking at his initial three cards and the dealer's exposed two cards.

The player loses both ante and challenge wager if the dealer's five-card hand ranks higher than the player's five-card hand or if the player's five-card hand does not rank, at least, an ACE High.

The player wins both the ante and the challenge wager (paid at 1 for 1) if the player's five-card hand ranks, at least, an ACE High and the player's five-card hand ranks higher than the dealer's five-card hand.

The preferred game also provides a side wager or side bet where the player has the option of wagering $1 in a wagering area labelled, for example, "Vegas Aces Paytable." In the preferred game, only the highest qualifying hand is paid on each player's side wager. For example, a player with a side wager who obtains a royal flush will only be paid for the royal flush ($4000 for 1) and not for the lesser flush ($25 for 1). A $1 Vegas Aces Paytable side wager preferably qualifies the player to win the following fixed paytable returns based on the player's ultimate five-card hand:

| Hand | Payout |
|---|---|
| Spell "VEGAS" | $225,000 for 1 |
| 4 ACES | $10,000 for 1 |
| Royal Flush | $4000 for 1 |
| Straight Flush | $250 for 1 |
| 4 of a Kind | $125 for 1 |
| Full House | $40 for 1 |
| Flush | $25 for 1 |
| Straight | $20 for 1 |
| 3 of a Kind | $8 for 1 |

II. Detailed Rules of Play

The dealer shuffles the Vegas Aces card deck no less than seven times. After the shuffle, the dealer offers the deck to one of the players to cut. After deck has been cut, the dealer takes top card face down and places it in the card holder.

Prior to the deal of the game, the dealer will ask players if all antes and paytable side wagers have been made. The player has the option to wager $1 and place a token or casino check into the paytable area above the ante triangle. The paytable side wager must be made for the player to be eligible for the pay schedule.

After all ante and paytable side wagers have been placed, the dealer "burns" the first card in the deck by placing it face down in the card holder and begins to deal. From left to right, the dealer gives each player one card face down. The dealer's first card in rotation of the deal is placed face up inside the rectangle to the far left as the dealer stands behind the table.

The second card dealt left to right to each player also is face down. The dealer's second card is placed face up to the immediate right of the first card, which is also face up.

The third card dealt to each player is face down and the dealer's third card in the rotation of the deal is face down inside the rectangle, to the immediate right of the dealer's second face-up card.

Now each player has three cards he can hold in his hand for review. Players cannot show their cards to any other player at the table or indicate in any way to another player what they have in their hand. A player can only play one hand at a time. If a player knowingly peeks at other players' cards to gain an edge, this person's hand can be declared null and void.

The player reviews the three cards in his hand and the dealer's two cards turned face up. At this point in the game, the player must decide if he wants to challenge the dealer's hand with the three cards in his hand. To do so, the player can wager from $1 to up to twice the amount of his ante. This rule applies to every ante ($1 up to 2 for 1).

Example: If the player places $5 in the ante triangle prior to the deal and the player wishes to challenge the dealer, he can place from $1 to $10 in the wager triangle.

Example: The player starts with a $5 ante and a $1 paytable side wager. Halfway through the game the player does not have any money to challenge the dealer for the back wager. The dealer breaks down the $5 ante into $1 units and distributes monies accordingly, $4 in the ante triangle and $1 in the challenge triangle.

Example: If a player' has a $25 check in the ante triangle and has no money left for the challenge wager, the dealer would again break down the ante wager. The dealer would put $24 in the ante triangle and $1 in the challenge triangle.

If the player does not wish to challenge the dealer, that player forfeits his paytable side and ante wagers to the house. The dealer will collect all forfeited wagers and the player's cards before continuing the deal. The dealer then takes the top card of the deck and places it face down in the card holder.

The dealer then deals a fourth card to each remaining player face up and places it to the right of the ante triangle as viewed by the player. The player cannot touch this card. The dealer's fourth card will be placed face down in the dealer rectangle to the immediate right of the dealer's third card, which is also face down.

The fifth and final card will be dealt left to right and placed face up next to each remaining player's fourth card. The dealer's fifth card in rotation will be placed face down inside the rectangle to the immediate right of the dealer's fourth card.

The final action of the deal is when the dealer turns his third, fourth, and fifth cards face up so players can evaluate their hand against the dealer's. Each player's hand of five cards must have an ace or better at the close of the hand. All players will be aware of the ace or better rule prior to the start of the deal. Rule states that after the deal is over and a player has stayed in the game, the player has to have an ace or better to remain in the game for payment. The dealer pays any hand that beats the dealer's hand and has an ace or better. If a player does not have an ace or better, the dealer will take all wagers (ante and challenge and paytable, if a paytable side wager was made), regardless of whether or not the player's hand beats the dealer's. It is the dealer's responsibility to review each hand for verification of an ace or better situation.

If the player's hand is higher than the dealer's, the dealer will pay even money on the player's ante wager and on the player's challenge wager. The dealer will also check all hands of the players who placed a side wager to see if any are eligible for payouts.

III. Example Hand

The following example assumes there are three players at a seven-base Vegas Aces table like that shown in FIG. 1. The three people sitting at the table are Mary, Sue, and Tom. Mary is on base one, Sue is on base two, and Tom is on base five (see layout).

The dealer shuffles the deck no less than seven times, asking if all antes and paytable side wagers have been made and placed. The dealer then offers Mary on base one the deck to cut. After the deck has been cut, the dealer takes the top card face down, letting no one see it, and places it in the card holder face down. The card holder is preferably to the right of the dealer as he faces the table (see layout).

Each player except Tom has placed $1 in the paytable side wager holder above the challenge triangle. Mary has placed a $5 casino check in the ante triangle. Sue has placed a $1 bill on the paytable side wager holder, which the dealer exchanges for a $1 casino check and replaces. Sue places a $10 bill into the ante triangle. The dealer exchanges the bill for two $5 casino checks and places these in the ante triangle. Tom did not participate on the paytable side wager, but placed a $25 casino check in the ante triangle.

Mary, Sue, and Tom are ready to receive their first three cards. The dealer deals Mary, Sue, and Tom each one card face down after burning the top card of the deck. They each pick up their cards for review. The dealer's first card goes face up in the far left of the dealer's rectangle as the dealer faces the table. Mary has the 10 of hearts, Sue has the ace of spaces with the letter V on it, and Tom has the king of clubs. The dealer has the 8 of hearts face up.

The second card is now dealt to each player face down. Mary receives the 10 of diamonds, Sue gets the 3 of diamonds, and Tom gets the 10 of clubs. The dealer's second card is the 2 of hearts. This card is turned face up to the immediate right of the dealer's first card.

The third card is dealt face down to each player. Mary receives the jack of spades, Sue receives the two of diamonds, and Tom receives the three of clubs. The dealer's third card goes face down next to the 2 of hearts. The dealer cannot peek at his face-down cards. Now each player is holding his three cards in his hand.

The dealer has two cards face up and one card face down. The players will now decide if they want to challenge the dealer's hand, with a wager of anywhere from $1 up to twice the amount of that player's ante. Mary has $5 in her ante triangle and places the maximum $10 in her challenge triangle directly in front of her. Sue has $10 in her ante triangle and chooses to place $6 in the challenge triangle directly in front of her on base two. Tom has $25 in his ante triangle on base five and decides to place the maximum amount of $50 in his challenge triangle. Now the dealer makes sure all challenge wagers have been made by asking the players. The dealer now burns the top card of the deck by placing it face down in the card holder.

The fourth card is now dealt to each player face up and placed on the table next to the player's ante triangle. Mary receives the 10 of spades, Sue gets the 3 of spades, and Tom receives the 7 of clubs. The dealer's fourth card is placed face down next to his third card, which is also face down.

The fifth card is dealt to each player face up next to the player's fourth card. The dealer's fifth card is dealt face down in the rectangle next to his fourth card. Mary receives the jack of hearts, Sue receives the ace of diamonds with the letter A on the card, and Tom receives the 9 of clubs.

The dealer now turns his three face-down cards over. The dealer's hand is the 8, 2, 9, 7, and queen of hearts for a queen high heart flush. All players now lay their cards face up on the table and wait for the dealer to expose the player's original first three cards dealt to them which they have tucked under their challenge wager.

On base one, Mary has a full house, three 10s, and two jacks. Mary has met the ace or better requirement, but Mary's hand, a full house, is beaten by the dealer's heart flush. The dealer looks at Mary's original three cards that are tucked underneath the challenge wager and, determining that the house hand beats her hand, takes her ante and challenge wagers, and pays her for playing the paytable and obtaining a full house. The dealer pays Mary $40 for 1 on a full house (see paytable schedule).

On base two, Sue has two pair, aces, and 3s. She has also met the ace or better requirement, but her poker hand does not beat the dealer's. As a result, her ante, challenge, and paytable wagers are collected by the dealer. Her hand does not qualify for a paytable payout, so that wager is also collected.

On base five, Tom's hand is a king high club flush, which beats the dealer's queen high flush. The dealer now pays Tom's ante and challenge wagers at even money, for a total of $75 going to Tom. Tom's hand is not eligible for a paytable payout because he did not participate.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of playing a card game comprising:

(a) accepting an ante wager from a player;

(b) alternately dealing three cards to the player and three cards to the dealer from a deck of playing cards in rotation;

(c) displaying at least one of the dealer's three cards as up cards for review by the player; and (d) permitting the player to "surrender" his ante wager or to place an additional "challenge" wager that ranges from a minimum challenge wager that is less than the ante wager to a maximum challenge wager, based on a comparison of his three cards and the dealer's at least one up card whereupon, (1) if the player decides to "surrender":

a) removing the player's ante wager; and b) dealing no further cards to the player, (2) if the player decides to "challenge":

a) accepting a challenge wager from the player;

b) alternately dealing two more cards face up to the player and two more cards face down to the dealer to form two ordinary five-card poker hands;

c) comparing the players five-card poker hand with the dealer's five-card poker hand based on a predetermined poker hand ranking, except that the player's five-card poker hand must contain an ace or higher to be eligible to win;

d) removing the player's ante wager and challenge wager if the dealer's five-card poker hand prevails or the player's five-card poker hand does not contain an ace or higher; and e) awarding the player a predetermined amount based on the ante wager and the challenge wager if the player's five-card poker hand prevails with an ace or higher.

2. The method of claim 1 wherein the deck of playing cards is a standard 52-card deck.

3. The method of claim 1 further comprising the steps of:

publishing a specified rate of return on a side wager for specified five-card poker hands;

accepting the side wager from the player at the time of accepting the ante wager;

determining if the player obtained one of the specified five-card poker hands; and paying the side wager at the predetermined rate of return to the player if he received one of the specified five-card poker hands.

4. The method of claim 3 wherein the deck of playing cards is a nonstandard 52-card deck in that a plurality of the playing cards carry predetermined indicia beyond standard indicia of their rank and suit and wherein one of the specified hands comprises a certain combination of the predetermined indicia.

5. The method of claim 4 wherein the predetermined indicia comprise the letters V, E, G, A, and S and the one of the specified hands is one that spells "VEGAS."

6. The method of claim 1 wherein the minimum challenge wager is one dollar.

7. The method of claim 1 wherein the at least one dealer's up card is comprised of two cards.

8. The method of claim 1 wherein the maximum challenge wager is a multiple of the ante wager.

9. A method of playing a card game comprising:

(a) accepting an ante and an optional side wager from a player;

(b) alternately dealing three cards to the player and three cards to the dealer from a deck of playing cards in rotation;

(c) displaying at least two of the dealer's three cards as up cards for review by the player; and (d) permitting the player to "surrender" his ante wager or to place an additional "challenge" wager based on a comparison of his three cards and the dealer's at least two up cards whereupon, (1) if the player decides to "surrender":

a) removing the player's ante wager and the optional side wager if it was made; and b) dealing no further cards to the player, (2) if the player decides to "challenge":

a) accepting a challenge wager from the player from a minimum challenge wager up to a maximum challenge wager;

b) alternately dealing two more cards face up to the player and two more cards face down to the dealer to form two ordinary five-card poker hands;

c) comparing the player's five-card poker hand with the dealer's five-card poker hand based on a conventional poker hand ranking except that the player's hand must contain at least an ace or higher to be eligible to win;

d) removing the player's ante wager and challenge wager if the dealer's five-card poker hand prevails; and e) awarding the player a predetermined amount based on the ante wager and the challenge wager if the player's five-card poker hand prevails with an ace or higher and, if it was made, a predetermined amount based on the optional side wager and the players five-card poker hand.

10. The method of claim 9 wherein the deck of playing cards is a standard 52-card deck.

11. The method of claim 9 wherein the deck of playing cards is a nonstandard 52-card deck in that a plurality of the playing cards carry predetermined indicia beyond standard indicia of their rank and suit and wherein the player, if the optional side wager was made, is awarded a predetermined amount for obtaining a five-card poker hand that comprises a certain combination of the predetermined indicia.

12. The method of claim 11 wherein the predetermined indicia comprise the letters V, E, G, A, and S and the certain combination of indicia is one that spells "VEGAS."

13. The method of claim 9 wherein the minimum challenge wager is one dollar.

14. The method of claim 9 wherein the maximum challenge wager is a multiple of the ante wager.

* * * * *